US005238528A

United States Patent [19]

Heinrich

[11] Patent Number: 5,238,528

[45] Date of Patent: Aug. 24, 1993

[54] PRODUCTION PROCESS FOR A NECKTIE

[76] Inventor: Matthias Heinrich, Honer Str.47a, W-3440 Eschwege 4, Fed. Rep. of Germany

[21] Appl. No.: 879,603

[22] Filed: May 7, 1992

[30] Foreign Application Priority Data

May 21, 1991 [DE] Fed. Rep. of Germany ..... 4116531

[51] Int. Cl.[5] ..... B44C 1/22; C23F 1/00

[52] U.S. Cl. ..... 156/633; 156/634; 156/645; 156/654; 156/659.1; 156/665

[58] Field of Search ..... 156/629, 633, 634, 645, 156/654, 655, 659.1, 656, 661.1, 665, 668

[56] References Cited

U.S. PATENT DOCUMENTS 3,813,310 5/1974 Droege et al. ..... 156/665

4,070,752 1/1978 Robinson ..... 156/659.1 X 4,215,194 7/1980 Shepherd ..... 156/634 X

FOREIGN PATENT DOCUMENTS 6921313 5/1969 Fed. Rep. of Germany .

*Primary Examiner*—William A. Powell

*Attorney, Agent, or Firm*—Thomas R. Shaffer

[57] ABSTRACT

A process for producing a necktie that has a number of components of rigid material is described. The process involves the steps of producing a blank from a flat plate of rigid material; fastening a flexible material to the rear side of the blank to connect the components to each other and separating connecting straps from the components. Various details regarding the production process are disclosed.

12 Claims, 1 Drawing Sheet

PRODUCTION PROCESS FOR A NECKTIE

BACKGROUND OF THE INVENTION

1. Field of the Invention

The invention concerns a process for manufacturing a necktie that has a number of components of a rigid material. Such a necktie is described in the German model patent 90 12 204, for example. Metal, wooden or synthetic materials, for example, are used for the components.

2. Description of the Prior Art

The production methods known to date for such or comparable articles do not meet the requirements of cost-favorable mass production. The German model patent 69 21 313 is mentioned here as an example; the stringing of the components on ribbons or cords is proposed in it.

SUMMARY OF THE INVENTION

The invention proposes the cost-favorable production of a necktie composed on many individual parts, in particular, a large number of components, in which case the components are produced from a rigid material with a thickness of, e.g., 0.1–3.0 mm.

This problem is solved according to the invention by the features of patent claim 1.

Holding and connecting webs serve to hold the components in their desired position after removal of the superfluous material, until the flexible material takes over the connection duties. Finally, they are served. To keep the costs in clipping the remainder of the web as low as possible, the straps should be as narrow as possible. In producing the blank according to the invention, the interspaces can be removed rapidly and cost-favorably in one procedural step. The individual cutting or sawing out of each components, as is possible only by hand, can be dispensed with. The production process can be highly automated.

The directional indications used for the arrangement of the holding straps concern the direction of fall of the finished necktie. By connecting the components with holding straps, the straps that connect two components of a necktie directly together can be dispensed with. Namely, such straps necessitate relatively high expenses during the clipping process. On the other hand, if all the components of a necktie are connected with a holding strap on both sides, the positional stability is also assured, and the expenditure in removing the straps is definitely less. The flexible material is usually applied only on the components and not on the other parts of the blank.

In an initial variant of the process according to the invention the removal of the interspaces is done by photoetching, where one or two templates that have the same surface form as the blank are used. This procedure is particularly well suited for metallic materials. The superfluous material in the interspaces is cleared out during the etching.

If a template is used, the front and rear sides are successively exposed individually. However, the use of two templates synchronized to each other in their form, one for the front side and one for the rear side of the flat plate, is favorable.

Not only can both sides thus be simultaneously exposed, but according to an additional aspect of the invention one of the two templates can liberate surfaces inside of the components. Patterns can be incorporated in this manner directly during production of the blank without the need for additional procedural steps. They appear during the etching process as recesses in the material. Tests revealed that an attractive color even results in the recesses directly during the etching process when aluminum is used.

When wood is used (veneer or plywood), or decorative plates or synthetic material (e.g., formica), as the rigid material, a second advantageous manner of removal of the interspaces is preferred, namely cutting the material out with a water jet.

The material of the flat plate, e.g., 1.0–2.5 mm thick wood, is separated by a sharp water jet and the blank produced. The components are thus cut out in a manner that is comparable with fretwork.

In the production method according to the invention it is also advantageous if after the first step, removal of the interspaces, a layer of lacquer is applied to the front side of the components. This serves as surface protection and envelopes the cut edges to prevent the danger of injury. This step is easy to carry out and can be integrated into an automatic production process.

In connection with the removal of the interspaces, the flexible material is preferably fastened by gluing on the rear side of the flat plate. In the meantime, the components are still held by the connection straps to the holding straps in their prescribed position.

The choice of the appropriate adhesive is of decisive importance for the durability of the necktie. According to another aspect of the invention, a thermoplastic adhesive is applied on the rear side of the components and then the flexible material is pressed at a high temperature.

The thermoplastic adhesive has an adhesion that meets the high requirements and does not need to be applied to the flexible material. (This would be externally visible at the interspaces and thus perturbing.) Application on one side is sufficient. The flexible material can be pressed optionally by ironing transfer or with a hot press.

It is favorable here if the front side of the flat plate is covered with a protective foil, e.g., a self-adhesive plastic foil, before applying the flexible material to prevent soiling by the adhesive.

It has proven particularly advantageous if felt is used as the flexible material in the production of the necktie according to the invention. Normal textile fabric is less well suited because the warp and weft of the fabric were cut in cutting off the edge of the necktie and threads were thus pulled out. Felt does not present these shortcomings. However, felt may be glued along the central axis of the necktie only in its distortion-free direction.

The flexible material is preferably stamped out appropriately before being fastened on the rear side of the flat plate of the necktie form. Problems arising from the later cutting of the flexible material, preferably consisting of felt, are thus avoided.

The production of the necktie is particularly advantageous if the blank is designed so that several neckties can be produced simultaneously from one flat plate. A number of neckties, e.g., two to ten, preferably two to five, can thus be cut out from one flat plate with a single etching or cutting process.

It is favorable in this case if the blank has a holding strap between the components of two adjacent neckties.

DETAILED DESCRIPTION OF THE PREFERRED EMBODIMENT

Figure 1:
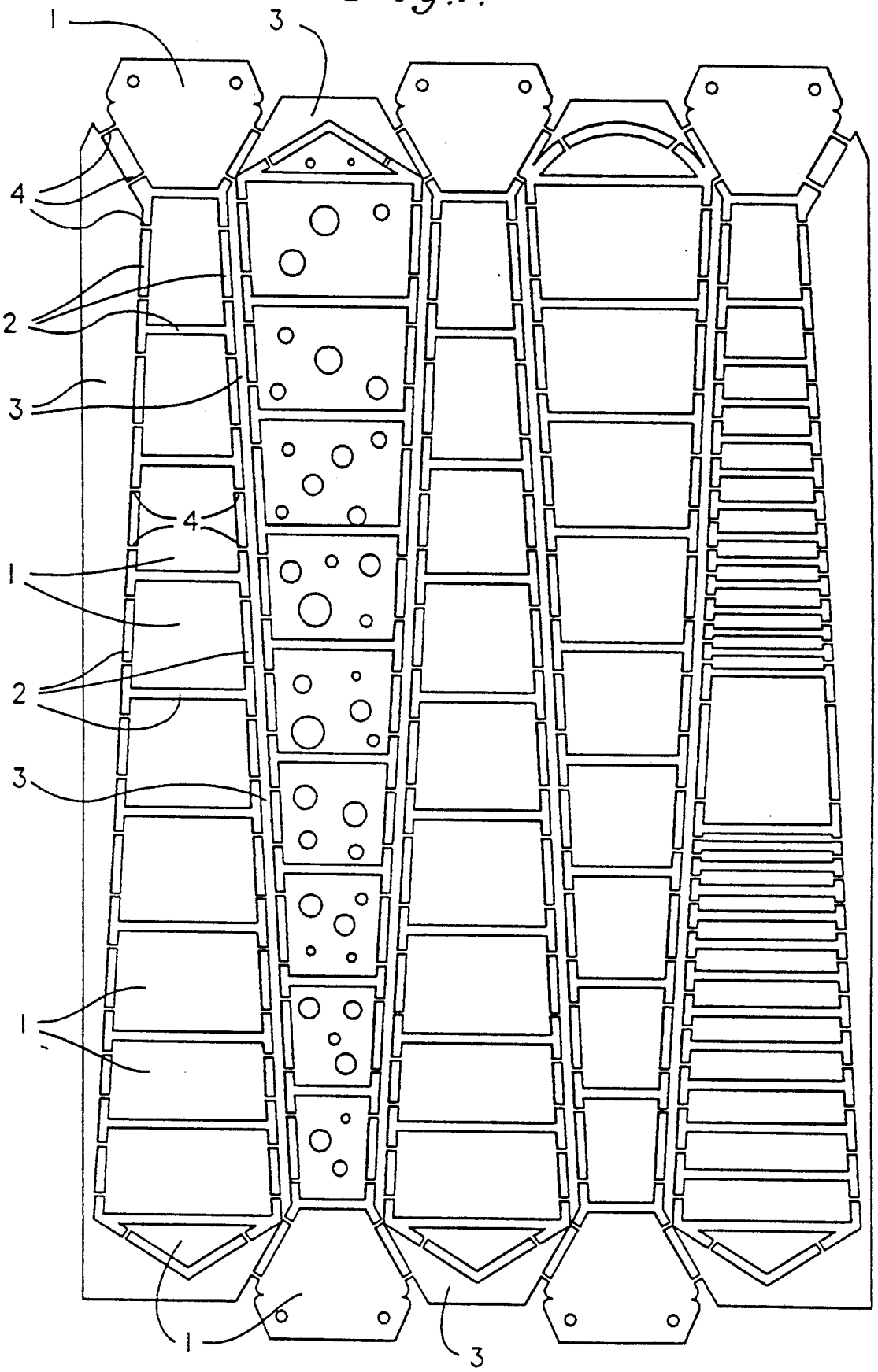
FIG. 1 is a top plan view of a blank utilized in connection with the process of the present invention.

The FIGURE shows an exemplary embodiment of a blank, such as that used in the invention process. Five neckties can be produced in one step with the template shown.

The template already has the components 1 of the subsequent neckties. The interspaces 2 remain free. There is a holding strap 3 laterally along each necktie The components 1 and the holding straps 3 are connected together by thin connecting straps 4.

Such a blank, with the aid of the invention process, facilitates an extremely cost-favorable and material-sparing production of neckties with components of a rigid material.

While certain presently preferred embodiments of the present invention have been described and illustrated, it is to be distinctly understood that the invention is not limited thereto but may be otherwise embodied and practiced within the scope of the following claims.

I claim:

1. A process for the production of a necktie having a number of components formed of a rigid material, comprising the steps of:

a) producing a blank from a flat plate of rigid material; said blank encompassing the components of the necktie to be produced; said blank having a left-hand and a right-hand holding strap laterally along said components, both of said straps positioned generally parallel to left-hand or right-hand edges of the components; said blank also having at least one pair of relatively slender connecting straps associated with each component, said connecting straps positioned to connect each component with said right-hand and left-hand holding straps; said blank also having interspaces between each pair of adjacent components and between the components on the one hand and the holding straps on the other up to the connecting straps, said interspaces being free of said rigid material;

b) fastening a flexible material on a rear side of the blank to connect the components to each other; and c) separating the connecting straps from the components.

2. A process according to claim 1, wherein said blank is produced by photoetching and where at least one template is used which has the same surface form as the blank.

3. A process according to claim 2, wherein two templates are used and one of the two templates exposes surfaces inside of the components.

4. A process according to claim 1, wherein the blank is cut out of said flat plate by water jet cutting.

5. A process according to claim 1, further comprising the step of applying a layer of lacquer to the front side of the components after the step of producing said blank is completed.

6. A process according to claim 1, wherein said flexible material is fastened on the rear side of the blank by gluing.

7. A process according to claim 6, wherein a thermoplastic adhesive is applied on the rear side of the components and then the flexible material is pressed onto the blank at a high temperature.

8. A process according to claim 1, wherein the front side of the flat plate is covered with a protective foil before the flexible material is applied.

9. A process according to claim 1, wherein felt is used as the flexible material.

10. A process according to claim 1, wherein the flexible material is appropriately stamped out prior to being fastened on the rear side of the blank of the necktie form.

11. A process according to claims 1, wherein the blank has several neckties.

12. A process according to claim 11, wherein the blank has a holding strap between the components of two adjacent neckties.

* * * * *